US005403126A

United States Patent [19]

Carriker et al.

[11] Patent Number: 5,403,126

[45] Date of Patent: Apr. 4, 1995

[54] SURFACE FRICTION ENHANCED GEOSYNTHETIC CLAY LINER

[75] Inventors: Richard Carriker, Woodstock; Mark Clarey, Dalton, both of Ga.; Robert Burton, Palos Heights, Ill.

[73] Assignee: James Clem Corporation, Chicago, Ill.

[21] Appl. No.: 36,761

[22] Filed: Mar. 25, 1993

[51] Int. Cl.[6] ..... E02D 3/12

[52] U.S. Cl. ..... 405/270; 405/129; 405/258

[58] Field of Search ..... 405/270, 268, 258, 16, 405/19, 34, 128, 129; 47/95

[56] References Cited

U.S. PATENT DOCUMENTS

| | | | |
|---|---|---|---|
| 4,555,201 | 11/1925 | Paoluccio | 405/204 X |
| 4,565,468 | 1/1986 | Cranford | 405/270 |
| 4,854,773 | 8/1989 | Nicoll | 47/95 X |
| 4,916,927 | 4/1990 | Robertson et al. | 405/270 |
| 5,174,231 | 12/1992 | White | 405/270 X |
| 5,180,255 | 1/1993 | Alexander | 405/270 |
| 5,237,945 | 8/1993 | White | 405/270 X |

*Primary Examiner*—Dennis L. Taylor
*Attorney, Agent, or Firm*—Baker & McKenzie

[57] ABSTRACT

A friction enhancing material is applied to at least one surface of the geosynthetic clay liner. The placement of friction enhancing material on the surface of the liner that engages a slope or embankment of a landfill helps the liner maintain its position during and after installation. The improved frictional contact between the liner and the slope or embankment permits use of bentonite liners on steeper slopes or embankments and therefore enables more efficient construction of landfills. The friction enhancement material may also be applied to the surface to improve contact between the upper surface of the geosynthetic clay liner and the cover soil. The friction enhancement material may be high density polyethylene, EVA, rubbers and other polymeric materials.

21 Claims, 3 Drawing Sheets

SURFACE FRICTION ENHANCED GEOSYNTHETIC CLAY LINER

SURFACE FRICTION ENHANCED GEOSYNTHETIC CLAY LINER

This invention relates generally to an improved geosynthetic clay liner for use on relatively steep slopes or embankments. Specifically, the invention relates to an improved geosynthetic clay liner with a lower surface that has been at least partially coated with a friction enhancing material. The friction enhancing material improves the frictional contact between the lower surface of the liner and the slope or embankment that comes in contact with the lower surface of the liner.

BACKGROUND OF THE INVENTION

The concept of using geosynthetic clay liners made with bentonite for lining landfill sites is well-known. The problem addressed by the present invention involves the prevention of the geosynthetic clay liner (GCL) from sliding down the slope or embankment surrounding the periphery of the landfill. The present invention may also be used in the construction of man-made lakes and ponds.

A GCL is commonly comprised of three major parts: (1) the primary carrier sheet, also known as the primary backing, primary textile or primary carrier; (2) a cover sheet, also known as the secondary textile, secondary carrier sheet or scrim; and (3) a layer of bentonite disposed therebetween.

Geosynthetic clay liners in current use are normally sewn or needle punched together to enhance the internal sheer strength of the liner and improve the performance of the liners when they are used on sloped surfaces. However, enhancing the internal sheer strength of the liners does not address the problem of the liners sliding down a slope or embankment during or after installation. If the liner is installed during wet conditions, this slippage problem is even more prevalent. Simply put, no geosynthetic clay liner found in the prior art provides an increased coefficient of friction between the underside of the liner and the surface in direct contact with the underside of the liner.

The inability of geosynthetic clay liners to maintain their position on steep slopes can also stem from the granular bentonite contained within the liner. Bentonite is a clay material that expands and becomes substantially impermeable upon being exposed to water. The layer of bentonite contained with the liners creates a low permeability barrier at the bottom of landfills. However, wet bentonite is extremely slippery. If any bentonite migrates through the lower sheet of the liner, the slippery bentonite will contribute to the inability of geosynthetic clay liner to maintain its positions on steep slopes and embankments. If the liner is made with tightly woven sheets or sheets with a closed structure that does not permit any leakage of bentonite, the sheets themselves may be slippery and contribute to the inability of the liner to maintain its position on a slope or embarkment.

Another problem associated with the use of geosynthetic clay liners on slopes or embankments is the downward sliding of cover soil after it is placed on top of the liner. Once installed, the liners are routinely covered with a layer of soil, i.e. cover soil. On steep slopes, the cover soil will often slide right off the upper surface of the liner. Therefore, a liner with a friction enhanced upper surface is needed to facilitate the placement of cover soil on top of the just-installed liner.

Many geosynthetic clay liners employing bentonite are restricted to slopes with a 4:1 ratio, that is, a horizontal to vertical ratio of 4:1. The development of liners with improved resistance to internal sheer stresses has improved this ratio to less than 4:1 and often obtaining ratios of less than 2:1. However, by providing a geosynthetic clay liner with a friction enhanced undersurface, it is expected that slope ratios will approach 1:1 when the internal sheer resistant techniques taught by the prior art are combined with the friction enhancement techniques taught by the present invention.

Thus, there is a need for an improved geosynthetic clay liner with an undersurface that provides enhanced frictional engagement between the undersurface of the liner and the slope or embankment that is in contact with the undersurface of the liner. There is also a need for an improved geosynthetic clay liner with an upper surface that provides enhanced frictional engagement between the upper surface of the liner and the cover soil.

SUMMARY OF THE INVENTION

The present invention satisfies the above-mentioned need by providing a geosynthetic clay liner that is suitable for use on steep slopes or embankments of landfills or other liquid containment sites. The improved geosynthetic clay liner includes a primary carrier sheet, a cover sheet and a layer of bentonite disposed between the primary carrier sheet and the cover sheet. The primary carrier sheet has an upper surface that engages the bentonite and a lower surface that engages the bottom of the landfill, or more particularly, the slope or embankment along the side of a landfill. The lower surface of the primary carrier sheet also includes a means for enhancing frictional contact between the lower surface of the primary carrier sheet and the landfill ground surface so that the ability of the entire geosynthetic clay liner to maintain its position on a relatively steep slope or embankment is improved.

The improved geosynthetic clay liner of the present invention may be manufactured from a variety of methods, two of which are illustrated below. First, the liner may be fabricated from a conventional method that includes depositing bentonite on top of the primary carrier sheet and thereafter placing the cover sheet on top of the bentonite. Then, the primary carrier sheet, bentonite and cover sheet are transported over a means for applying friction enhancing material to the lower surface of the primary carrier sheet. The preferred means for applying friction enhancing material to the lower surface of the primary carrier sheet includes a fluted roller disposed underneath the moving primary carrier sheet. The fluted roller is mounted over a bath containing liquified friction enhancing material. The primary carrier sheet engages the roller, the roller rotates and is continuously dipped into the bath of liquid friction enhancing material. Therefore, each segment of the roller is dipped in the liquid friction enhancing material and thereafter engages the lower surface primary carrier sheet thereby depositing some friction enhancing material on the lower surface of the primary carrier sheet. The fluted roller method described above is the preferred method for placing parallel rows of friction enhancing material on the lower surface of the primary carrier sheet. The parallel rows of friction enhancing material preferably extend the width of a rolled-up geosynthetic clay liner. The fluted volley method may also be employed to apply friction enhancing material to the cover sheet to enhance the ability of cover soil to maintain its position on top of the cover sheet.

A second method for depositing friction enhancing material on the geosynthetic clay liner involves the use of a spray bar mounted over or under a just-fabricated geosynthetic clay liner that is travelling down an assembly line. The spray bar is effective at applying rows of friction enhancing material that are parallel to the forward direction of travel of the liner. The spray bar is most useful when spraying downward on top of a liner and it is contemplated that the spray bar method may be used to apply friction enhancing material on the cover sheet as well as the primary carrier sheet. Of course, the surface on which friction enhancing material is to be sprayed must be facing the spray bar.

The spray bar and fluted roller may be combined to apply friction enhancing material to both the cover sheet and primary carrier sheet. Further, an upper and lower spray bar may be employed.

The main difference between the spray bar and fluted roller is the alignment of the rows of friction enhancing material. Fluted rollers apply the material in rows that are perpendicular to the direction the liner is travelling as it proceeds down the assembly line. If the liner is rolled up at the end of the line, the rows of material will be parallel to the axis of the roll and will be perpendicular to the slope or embankment if the liner is installed by rolling it down the slope or embankment. On the other hand, the spray bar provides rows of material parallel to the direction the liner is travelling down the assembly line and perpendicular to the axis if the liner is provided in a roll.

For purposes of nomenclature, when the primary carrier sheet and cover sheet are made from identical materials, the terms first sheet and second sheet are used for simplicity. As noted below, it is often advantageous to apply friction enhancing material to the surface that engages the slope (normally the primary carrier sheet) as well as the upward facing surface (normally the cover sheet).

Finally, the friction enhancing material may be applied in a variety of patterns in addition to parallel lines. For example, crosshatch, and curvilinear patterns are within the scope of the present invention.

It is therefore an object of the present invention to provide an improved geosynthetic clay liner with an enhanced ability to maintain its position on a steep slope or embankment.

It is also an object of the present invention to provide a geosynthetic clay liner that will maintain its position on slopes with horizontal to vertical ratios of less than 4:1.

Yet another object of the present invention is to provide a geosynthetic clay liner with a friction enhanced lower surface and friction enhanced upper surface.

It is also an object of the present invention to provide an improved method for fabricating geosynthetic clay liners with at least one friction enhanced surface.

BRIEF DESCRIPTION OF THE DRAWINGS

This invention is illustrated diagrammatically in the accompanying drawings, wherein.

DETAILED DESCRIPTION OF THE DRAWINGS

Figure 1:
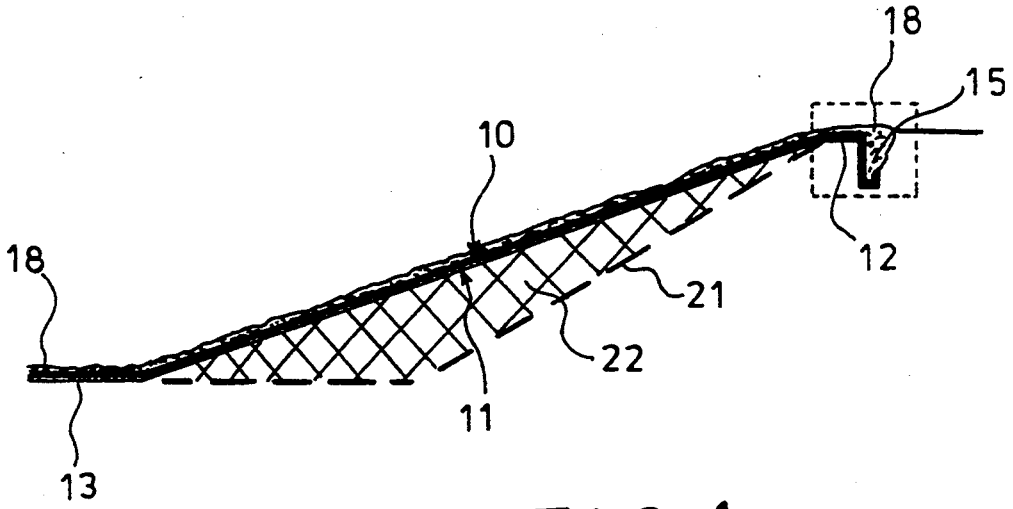
FIG. 1 is a side sectional view showing the advantage of using a geosynthetic clay liner of the present invention as opposed to a conventional geosynthetic clay liner.

Like reference numerals will be used to refer to like or similar parts from figure to figure in the following description of the drawings.

Figure 2:
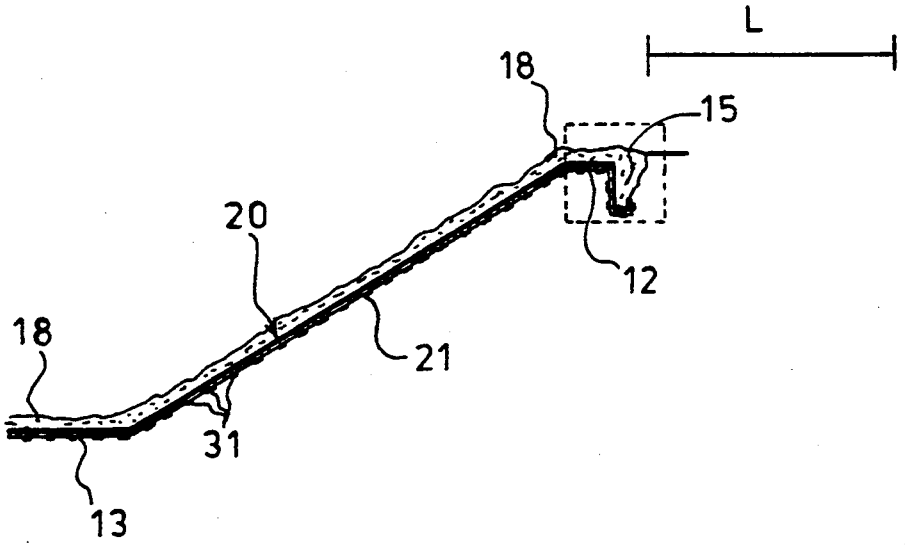
FIG. 2 is a side sectional view showing the advantage of using a geosynthetic clay liner made in accordance with the present invention.

FIGS. 1 and 2 illustrate the advantages of using geosynthetic clay liners made in accordance with the present invention and the problem associated with liners known in the art. A conventional geocomposite clay liner indicated generally at 10 is installed on a slope 11. The slope 11 shown in FIG. 1 has a horizontal to vertical ratio of approximately 4:1. An upper flat region 12 and a lower flat region 13 are disposed on either side of the sloped region 11. The portion of the liner 10 covering the upper flat region 12 is placed in a trench 15 and cover soil 18 is applied on top of the liner 10. As discussed above, the bentonite disposed between the primary carrier sheet and cover sheet becomes very slippery when exposed to water. Further, most materials used to fabricate lower carrier sheet or the underside of the liner 10 are relatively smooth and therefore do not provide sufficient frictional contact between the slope 11 and liner 10. It has been found that conventional geosynthetic clay liners 10 will slide down slopes that are much steeper than the slope shown at 11.

In contrast, the improved geosynthetic clay liner shown generally at 20 (see FIG. 2) has improved frictional engagement between the undersurface of the liner 20 and the slope shown at 21. Because of the enhanced frictional contact between the liner 20 and the slope 21, the liner 20 is capable of maintaining its position on the steeper slope 21 with a relatively low horizontal to vertical ratio while the conventional geocomposite clay liner 10 (see FIG. 1) is capable of maintaining its position only on slopes 11 with high horizontal to vertical ratios. The slope 21 shown in FIG. 2 has a horizontal to vertical ratio of about 1.2:1 while the horizontal to vertical ratio shown in FIG. 1 is about 4:1.

The advantage of using the lower ratio is illustrated by examining the crosshatched section 22 shown in FIG. 1. The crosshatched section 22 represents the additional volume available by using the steeper slope 21 as opposed to the shallower slope 11. The increased volume 22 available for fill represents a more efficient use of land in both landfill and tank farm applications. The present invention achieves the illustrated efficiency without sacrificing the desirable aspects afforded by the use of geosynthetic clay liners made with bentonite.

Figure 3:
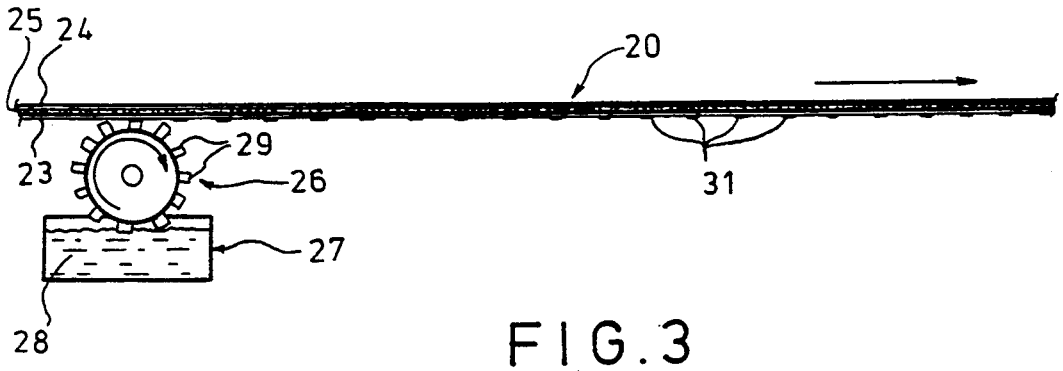
FIG. 3 is a side elevational view showing one method of manufacturing an improved geosynthetic clay liner in accordance with the present invention.
Figure 4:
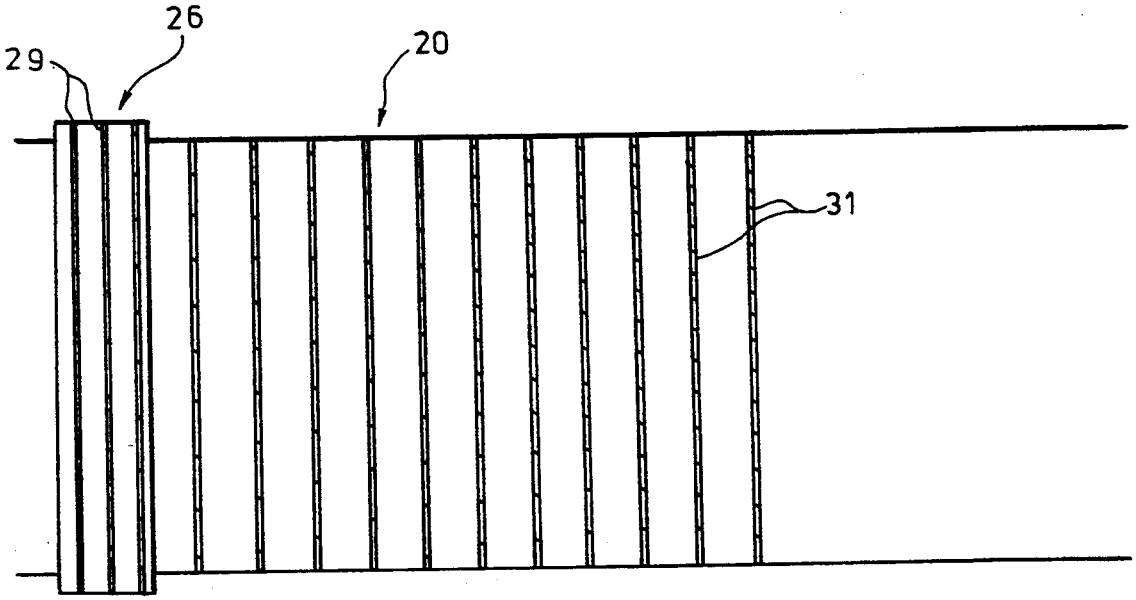
FIG. 4 is a bottom view of the method illustrated in FIG. 3.

Referring now to FIGS. 3 and 4, a method of manufacturing an improved geosynthetic clay liner 20 is illustrated. A liner 20 is passed over a flute roller 26. The liner 20 includes a primary carrier sheet 23, a cover sheet 24 and a layer of bentonite 25 disposed therebetween. The roller 26 is disposed over a bath 27 containing liquid friction enhancement material 28. As the liner 20 traverses over the roller 26, the roller 26 is rotated and the fluted portions 29 are dipped into the bath 27 and coated with the friction enhancement material 28 and thereafter rotate upward to engage the undersurface of the primary carrier sheet 23. The result is a series of horizontal stripes 31 of friction enhancement material 28 disposed on the underside of the primary carrier sheet 23. It has been assumed that the primary carrier sheet 23 will be disposed downward and will engage the slope 21 of the landfill. In the preferred embodiment, the liners 20 are provided in rolls (not shown) for easy transport and installation.

Figure 5:
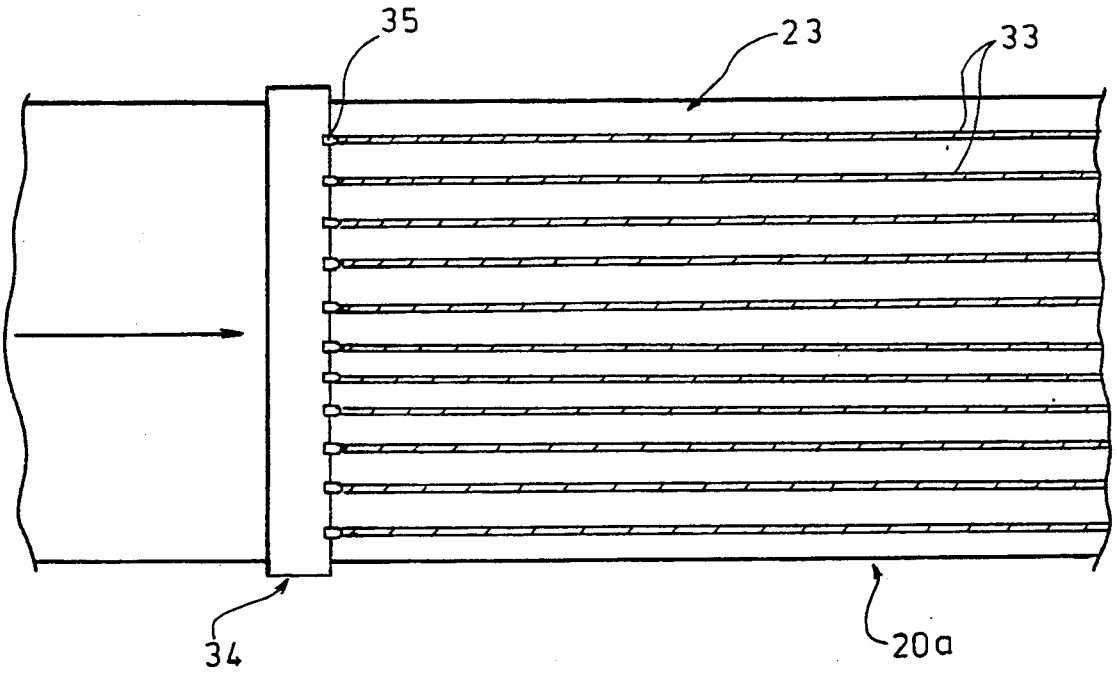
FIG. 5 is a top view of an alternative method of manufacturing an improved geosynthetic clay liner in accordance with the present invention.
Figure 6:
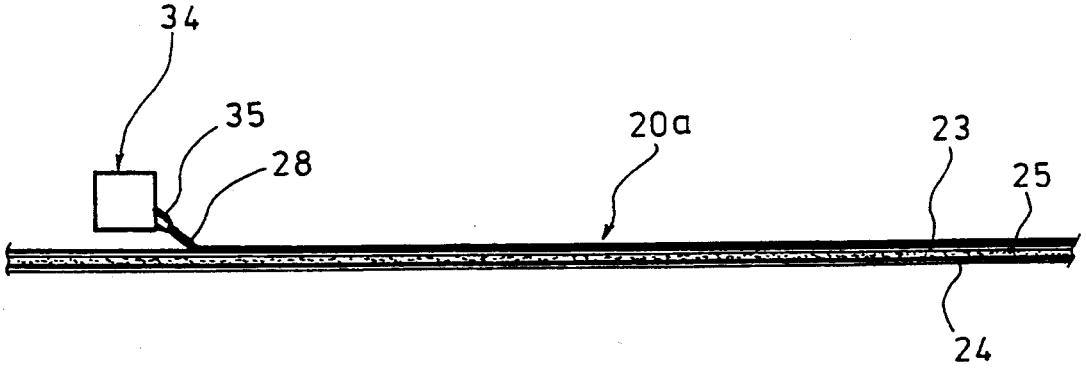
FIG. 6 is a side view of the method illustrated in FIG. 5.

Referring now to FIGS. 5 and 6, an alternative method of manufacturing the improved geocomposite clay liner 20*a* is illustrated. The liner 20*a* includes a series of parallel stripes 33 of friction enhancement material 28. The stripes 33 are deposited on the liner 20*a* with a spray bar 34. A series of nozzles 35 spray the friction enhancement material 28 on to an exposed upper surface of the liner 20*a*. It will be noted that the apparatus shown in FIGS. 5 and 6 can be used to apply the friction enhancement material 28 to either the primary carrier sheet 23 (as illustrated) or the cover sheet 24. In some embodiments, the primary carrier sheet 23 and the cover sheet 24 are made of like or identical material. In these instances, it is easier to refer to the two sheets simply as first and second sheets.

One preferred material for use as the friction enhancement material 28 is high density polyethylene. Another preferred material is polyvinyl acetate. Other flexible plastics and polymeric elastomers fall within the scope of the invention. As discussed above, the material 28 should be one that is available in a form that is sprayable, spreadable or otherwise applicable to a carrier sheet. Further, the material 28 should be one that sets, dries or otherwise hardens into a solid state that enhances the frictional engagement between the carrier sheet and a layer of soil disposed underneath.

Although only one preferred embodiment and two preferred methods of manufacture have been illustrated and described, it will at once be apparent to those skilled in the art that variations may be made within the spirit and scope of the present invention. Accordingly, it is intended that the scope of the invention be limited solely by the scope of the hereafter appended claims and not by any specific wording in the foregoing description.

We claim:

1. A geosynthetic clay liner for use in forming a continuous clay layer in a landfill having at least one sloped side, the geosynthetic clay liner comprising:

a primary carrier sheet for supporting a layer of bentonite, the layer of bentonite disposed on an upper surface of the primary carrier sheet, the primary carrier sheet being fabricated from plastic and providing a non-biodegradable support structure for the layer of bentonite, a cover sheet for enclosing the layer of bentonite between the primary carrier sheet and the cover sheet, the cover sheet being disposed on top of the layer of bentonite, the primary carrier sheet including a lower outwardly facing surface, the lower outwardly facing surface including friction enhancing material applied separately thereto for enhancing frictional contact between the liner and and the sloped side of the landfill disposed therebelow.

2. The geosynthetic clay liner of claim 1, wherein the friction enhancing material applied to the lower outwardly facing surface of the primary carrier sheet consists essentially of high density polyethylene.

3. The geosynthetic clay liner of claim 2, wherein the friction enhancing material is applied to the lower outwardly facing surface of the primary carrier sheet in generally parallel rows.

4. The geosynthetic clay liner of claim 1, wherein the friction enhancing material applied to the lower outwardly facing surface of the primary carrier sheet consists essentially of polyvinyl acetate.

5. The geosynthetic clay liner of claim 4, wherein the friction enhancing material is applied to the lower outwardly facing surface of the primary carrier sheet in generally parallel rows.

6. The geosynthetic clay liner of claim 1, wherein the cover sheet includes an upper outwardly facing surface and friction enhancing material is also applied to the upper outwardly facing surface of the cover sheet.

7. The geosynthetic clay liner of claim 6, wherein the friction enhancing material applied to the upper outwardly facing surface of the cover sheet consists essentially of high density polyethylene.

8. The geosynthetic clay liner of claim 7, wherein the friction enhancing material is applied to the upper outwardly facing surface of the cover carrier sheet in generally parallel rows.

9. The geosynthetic clay liner of claim 6, wherein the friction enhancing material applied to the upper outwardly facing surface of the cover sheet consists essentially of polyvinyl acetate.

10. The geosynthetic clay liner of claim 9, wherein the friction enhancing material is applied to the upper outwardly facing surface of the cover carrier sheet in generally parallel rows.

11. A geosynthetic clay liner for use in forming a continuous clay layer in a landfill having at least one sloped side, the geosynthetic clay liner comprising:

a primary carrier sheet for supporting a layer of bentonite, the layer of bentonite disposed on an upper surface of the primary carrier sheet, the primary carrier sheet engaging the sloped side of the landfill, a cover sheet for enclosing the layer of bentonite between the primary carrier sheet and the cover sheet, the cover sheet being disposed on top of the layer of bentonite, the cover sheet being fabricated from plastic and providing a non-biodegradable protective cover for the layer of bentonite, the cover sheet including an upper outwardly facing surface, the upper outwardly facing surface including friction enhancing material applied separately thereto for enhancing frictional contact between the liner and material disposed adjacent thereto thereby inhibiting said material from sliding down the sloped side of the landfill.

12. The geosynthetic clay liner of claim 11, wherein the friction enhancing material applied to the upper outwardly facing surface of the cover sheet consists essentially of high density polyethylene.

13. The geosynthetic clay liner of claim 12, wherein the friction enhancing material is applied to the upper outwardly facing surface of the cover sheet in generally parallel rows.

14. The geosynthetic clay liner of claim 11, wherein the friction enhancing material applied to the upper outwardly facing surface of the cover sheet consists essentially of polyvinyl acetate.

15. The geosynthetic clay liner of claim 14, wherein the friction enhancing material is applied to the upper outwardly facing surface of the cover sheet in generally parallel rows.

16. The geosynthetic clay liner of claim 11, wherein the primary carrier sheet includes a lower outwardly facing surface and friction enhancing material is also applied to the lower outwardly facing surface of the primary carrier sheet.

17. The geosynthetic clay liner of claim 16, wherein the friction enhancing material applied to the lower outwardly facing surface of the primary carrier sheet consists essentially of high density polyethylene.

18. The geosynthetic clay liner of claim 17, wherein the friction enhancing material is applied to the lower outwardly facing surface of the primary carrier sheet in generally parallel rows.

19. The geosynthetic clay liner of claim 16, wherein the friction enhancing material applied to the lower outwardly facing surface of the primary carrier sheet consists essentially of polyvinyl acetate.

20. The geosynthetic clay liner of claim 19, wherein the friction enhancing material is applied to the lower outwardly facing surface of the primary carrier sheet in generally parallel rows.

21. A geosynthetic clay liner for use in forming a continuous clay layer in a landfill having at least one sloped side, the geosynthetic clay liner comprising:

a primary carrier sheet for supporting a layer of bentonite, the layer of bentonite disposed on an upper surface of the primary carrier sheet, the primary carrier sheet engaging the sloped side of the landfill, the primary carrier sheet being fabricated from plastic and providing a non-biodegradable support structure for the layer of bentonite, a cover sheet for enclosing the layer of bentonite between the primary carrier sheet and the cover sheet, the cover sheet being disposed on top of the layer of bentonite, the cover sheet being fabricated from plastic and providing a non-biodegradable protective cover for the layer of bentonite, the primary carrier sheet including a lower outwardly facing surface, the lower outwardly facing surface including friction enhancing material applied separately thereto for enhancing frictional contact between the liner and the sloped side of the landfill disposed therebelow, the cover sheet including an upper outwardly facing surface, the upper outwardly facing surface including friction enhancing material applied separately thereto for enhancing frictional contact between the liner and material disposed adjacent thereto, the friction enhancing material is applied to the lower outwardly facing surface of the primary carrier sheet and the upper outwardly facing surface of the cover sheet in generally parallel rows, the friction enhancing material selected from the group consisting of high density polyethylene and polyvinyl acetate.

* * * * *